US009903494B2

(12) United States Patent
Prior

(10) Patent No.: US 9,903,494 B2
(45) Date of Patent: Feb. 27, 2018

(54) LIQUID CONTAINER LEVELER

(71) Applicant: Jeffrey J. Prior, Shelton, CT (US)

(72) Inventor: Jeffrey J. Prior, Shelton, CT (US)

( * ) Notice: Subject to any disclaimer, the term of this patent is extended or adjusted under 35 U.S.C. 154(b) by 0 days.

(21) Appl. No.: 14/717,811

(22) Filed: May 20, 2015

(65) Prior Publication Data

US 2016/0341326 A1 Nov. 24, 2016

(51) Int. Cl.
*F16K 21/18* (2006.01)
*E04H 4/12* (2006.01)

(52) U.S. Cl.
CPC ..... *F16K 21/18* (2013.01); *E04H 4/1272* (2013.01)

(58) Field of Classification Search
CPC ..... F16K 21/18; E04H 4/1209; E04H 4/14
USPC ..... 210/167.1
See application file for complete search history.

(56) References Cited

U.S. PATENT DOCUMENTS

| | | | |
|---|---|---|---|
| 210,334 | A | 11/1878 | Kinsman |
| 306,929 | A | 10/1884 | Johnson |
| 328,354 | A | 10/1885 | Stears |
| 434,689 | A | 8/1890 | Wade |
| 760,342 | A | 5/1904 | Metosh |
| 854,522 | A | 5/1907 | Newman |
| 865,300 | A | 9/1907 | Glidden |
| 1,035,457 | A | 8/1912 | Madden |
| 1,051,393 | A | 1/1913 | Dunlap |
| 1,056,353 | A | 3/1913 | Moore |
| 1,191,088 | A | 7/1916 | Mercer |
| 1,235,387 | A | 7/1917 | Serper |
| 1,262,545 | A | 4/1918 | Mueller |
| 1,281,222 | A | 10/1918 | Stepanchak |
| 1,353,313 | A | 9/1920 | Waechter |
| 1,512,919 | A | 10/1923 | Fraser |
| 1,531,322 | A | 3/1925 | Waechter |
| 1,598,162 | A | 8/1926 | Solomon |
| 1,620,164 | A | 3/1927 | Milliff et al. |
| 1,805,560 | A | 5/1931 | Barta |
| 1,870,089 | A | 8/1932 | Bloch |
| 1,931,568 | A | 10/1933 | Brotz |
| 1,984,950 | A | 12/1934 | Steen |
| 2,245,946 | A | 6/1941 | Vermere |
| 2,394,094 | A | 2/1946 | Nichol |
| 2,398,921 | A | 4/1946 | Cook |

(Continued)

FOREIGN PATENT DOCUMENTS

| | | |
|---|---|---|
| CH | 279573 | 3/1952 |
| CH | 351379 | 2/1961 |

(Continued)

*Primary Examiner* — Fred Prince
(74) *Attorney, Agent, or Firm* — Ware, Fressola, Maguire & Barber LLP

(57) ABSTRACT

An apparatus is provided to allow over filling a fluid level and a means of bringing the fluid level back to a desired operating condition. The apparatus can be installed at a specific fluid level while other members can vary or turn off the automatic fluid leveling feature. The apparatus includes a bore hole or chamber that runs completely through the thickness of the container. A member can be provided with an adapted fit and mate with a wall in the bore hole. This member contains a control feature which in the normal position allows for overflowing the apparatus with fluid, and when enabled, can bring the fluid level in the apparatus back to its desired level.

11 Claims, 5 Drawing Sheets

(56) References Cited

U.S. PATENT DOCUMENTS 2,453,593 A * 11/1948 Putney ..... B01D 45/14 55/398
2,574,205 A 11/1951 Blumenthal
2,607,045 A 8/1952 Morris
2,659,387 A 11/1953 Farris
2,666,211 A 1/1954 Schmid
2,673,011 A 3/1954 Rood et al.
2,681,751 A 6/1954 Stone et al.
2,767,732 A 10/1956 Hodgson et al.
2,767,927 A 10/1956 Green
2,908,249 A 10/1959 Rokosz et al.
3,076,976 A 2/1963 Bogar
3,221,347 A 12/1965 Emery
3,228,037 A 1/1966 Winkler
3,307,206 A 3/1967 Kreuger
3,493,978 A 2/1970 Hindman et al.
3,497,878 A 3/1970 Emery
3,521,305 A 7/1970 Fulton et al.
3,570,020 A 3/1971 Kato
3,795,924 A 3/1974 Kempler
3,859,676 A 1/1975 Kato
3,927,428 A 12/1975 Jette et al.
4,036,755 A * 7/1977 Dahm ..... B01D 27/08 210/167.04
4,135,260 A 1/1979 Gresh
4,194,251 A 3/1980 Pennerstorfer
4,446,583 A 5/1984 Dean
4,499,615 A 2/1985 Radovsky
4,542,545 A 9/1985 Johnson et al.
4,586,204 A 5/1986 Daniels
4,716,605 A 1/1988 Shepherd et al.
5,012,535 A 5/1991 Klotzbach
5,025,509 A 6/1991 Holt et al.
5,228,153 A 7/1993 Frankel
5,425,145 A * 6/1995 Baker ..... E04H 4/1227 210/167.1
5,685,974 A * 11/1997 Fleming ..... B01D 17/0211 210/187
6,008,728 A 12/1999 Wesey
6,052,844 A 4/2000 Walsh et al.
6,054,045 A * 4/2000 Wittstock ..... B01D 21/0012 210/167.01
6,138,294 A * 10/2000 Desjoyaux ..... E04H 4/1209 210/167.12
6,138,298 A 10/2000 Ball
6,187,181 B1 * 2/2001 Stoltz ..... E04H 4/1263 15/1.7
6,192,531 B1 2/2001 Fritz et al.
6,216,288 B1 4/2001 Bernau
6,289,532 B1 9/2001 Fritz et al.
6,295,665 B1 10/2001 Domenig
6,357,060 B2 3/2002 Gloodt
6,387,252 B1 * 5/2002 Desjoyaux ..... B01D 29/27 210/167.12
6,480,113 B1 11/2002 Esposito
6,618,875 B1 9/2003 Oropallo et al.
6,823,540 B2 11/2004 Gunn
6,845,528 B2 1/2005 Bantz
6,895,610 B2 5/2005 Olson
6,988,282 B2 1/2006 Barnett et al.
7,017,199 B2 3/2006 Oropallo et al.
7,096,522 B2 8/2006 Hirtriter
7,490,376 B2 2/2009 McMullen
8,006,325 B2 8/2011 Stimpson et al.
8,028,357 B2 10/2011 Ball
8,166,584 B2 5/2012 Ball
8,201,289 B2 6/2012 Edmonds et al.
8,239,982 B2 8/2012 Fryan
8,251,015 B2 8/2012 Potter
8,302,220 B2 11/2012 Ball
8,321,970 B2 12/2012 Ball
8,479,761 B2 7/2013 Yang
8,549,678 B2 10/2013 Neidich et al.
8,635,719 B2 1/2014 Homami et al.
8,887,325 B2 11/2014 Antoniello
2004/0148693 A1 8/2004 Anderson
2010/0107328 A1 5/2010 Brooks
2011/0100486 A1 5/2011 Brewton, III et al.
2013/0020246 A1 * 1/2013 Hoots ..... B01D 29/13 210/232
2013/0025046 A1 1/2013 Yu et al.
2013/0042406 A1 2/2013 Marotz et al.

FOREIGN PATENT DOCUMENTS

DE 909320 4/1954
DE 1217888 5/1966
DE 4226685 2/1994
DE 102008036900 4/2010
EP 0131661 1/1985
EP 0845559 6/1998
EP 0898926 3/1999
EP 1167643 1/2002
EP 1612337 1/2006
EP 1826324 8/2007
EP 2489794 8/2012
FR 762406 4/1934
GB 984468 2/1965
JP 2115424 4/1990
JP 1170053 3/1999
JP 2002364933 12/2002
JP 2005058381 3/2005
WO 2005066425 7/2005
WO 2011002598 1/2011

* cited by examiner

LIQUID CONTAINER LEVELER

FIELD OF THE INVENTION

The present invention relates to a container and skimming device that is particularly adapted for the redirection of the water flow away from a filter device used in connection with a fluid source and for regulating the fluid level in the fluid source.

BACKGROUND OF THE INVENTION

In swimming pools and other water or fluid containing structures, the water level will routinely rise as a result of rain, water displacement and other factors. When the water level rises higher than a user desires, the process of draining the swimming pool to the desired level is difficult and imprecise. The user must constantly monitor the water level while the water is being drained from a drain in the pool and if the water level drops too much, then the user will need to add more water to the pool, and repeat the process until the desired water level is attained.

There is thus a need in the art to provide a simple and relatively inexpensive control containment device that can provide for the control of a fluid level with ease and convenience, and which can be adapted for use with existing swimming pools or other similar structures. The present invention aims to solve these shortcomings in the art.

SUMMARY OF THE INVENTION

It is therefore a principal object of this invention to provide a control device to enable the control of an over fill condition that can be brought back to a desired predetermined level.

The foregoing objects and others are accomplished in accordance with this invention by providing a novel control means comprising a leveling apparatus that can be installed at a specific fluid level, comprising other members that can vary or turn off the automatic fluid leveling feature. A cut-out portion of the apparatus has a bore hole that runs completely through the thickness of the container, serving as a spill way. A control member can be obtained with an adapted fit to mate with the bore hole. The control member contains a control feature which enables the active/inactive control of the spill way at will, thereby bring the fluid level back to its desired level. An adjusting member can be also used situations which may need level adjustment. A cover member is thereafter placed over the cut-out portion. The cover member is also located in a position that will be flush with an outside portion of the spill way. The cover member ensures excess fluid motion by preventing foreign objects from entering the apparatus and erroneously adjusting the fluid level. In this embodiment it is thus possible to control the fluid level via the external control member in order to maintain optimal operating level.

The spill way of this invention is economically manufactured and is particularly advantageous for large volume usage. The control member used with the device of this invention can be any conventional type of shut off valve. Any suitable material may be used to manufacture the containment device of this invention.

In accordance with a first aspect of the invention, an apparatus is provided. The apparatus according to the first aspect of the invention comprises a housing surrounding a first chamber and a second chamber. The first and second chambers are partially separated by an inner wall inside the housing. A fluid inlet connected to the housing is provided that is configured to receive fluid into the first chamber. The first chamber includes a first fluid outlet and the second chamber includes a second fluid outlet. A control device is affixed to the second fluid outlet configured to control the release of fluid from the second chamber through the second fluid outlet.

In an embodiment of the apparatus according to the first aspect of the invention, the control device comprises a valve configured to be opened and closed to control the release of fluid through the second fluid outlet. The valve can be controlled by a lever affixed to a housing for the control device. The control device in an embodiment of the invention can be a standard shut-off valve.

In a further embodiment of the apparatus according to the first aspect of the invention, the fluid inlet comprises a fluid inlet connector configured to connect the apparatus to a second apparatus comprising a fluid so that the fluid enters the apparatus through the fluid inlet. The inner wall can be configured to have a height such that fluid in the first chamber will overflow into the second chamber when the level of the fluid in the first chamber rises above the height of the inner wall. The second apparatus has an adjustable fluid level and the fluid level in the first chamber corresponds to the fluid level in the second apparatus. The control device is configured to permit the release of fluid from the second chamber until the fluid level in the second apparatus is such that to the fluid level in the first chamber is at or below the height of the inner wall. The release of fluid that has overflowed into the second chamber from the second chamber reduces the fluid level in the first chamber and in the second apparatus. In one embodiment of the invention, the fluid inlet connector is configured to connect the apparatus to an opening in a swimming pool.

According to one embodiment of the apparatus of the first aspect of the invention, a fluid level adjustment unit is provided, which is configured to be placed on the inner wall within the apparatus. In one embodiment, the fluid level adjustment unit includes a U-shaped member configured to fit over the inner wall, a threaded bore hole extending through the U-shaped member and a threaded member configured to be inserted into the threaded bore hole. The threaded member is configured to elevate the U-shaped member away from the inner wall as the threaded member is threaded into the threaded bore hole. According to this embodiment of the apparatus of the present invention, the fluid inlet may comprise a fluid inlet connector configured to connect the apparatus to a second apparatus comprising a fluid so that the fluid enters the apparatus through the fluid inlet. The fluid level adjustment unit can be positioned on the inner wall so that a top surface of the U-shaped member defines a height wherein fluid in the first chamber will overflow into the second chamber when the level of the fluid in the first chamber rises above the top surface of the U-shaped member at said height. The second apparatus has an adjustable fluid level and the fluid level in the first chamber corresponds to the fluid level in the second apparatus. The control device is configured to permit the release of fluid from the second chamber until the fluid level in the second apparatus is such that the fluid level in the first chamber is at or below the height of the top surface of the U-shaped member of the fluid level adjustment unit.

In an embodiment of the apparatus of the first aspect of the invention, the apparatus further comprises a first cover and a second cover. The first cover is dimensioned to cover a top surface of the second chamber has at least a first tab configured to be inserted into a tab receiving section in the housing. The second cover is dimensioned to cover a top surface of the first chamber and is configured to overlay at least a second tab of the first cover, further securing the first cover in place.

In an embodiment of the first aspect of the invention, the apparatus is a pool skimming unit configured to skim water and debris from the top surface of the swimming pool. The apparatus in this embodiment may further comprise a basket or mesh strainer positioned above the first fluid outlet, which is connected to a filtration system.

According to a further embodiment of the first aspect of the invention, the first fluid outlet and the second fluid outlet comprise threaded openings.

According to a second aspect of the invention, a system is provided. The system comprises a first apparatus comprising a housing surrounding a first chamber and a second chamber. The first and second chambers are partially separated by an inner wall inside the housing. A fluid inlet connected to the housing is provided that is configured to receive fluid into the first chamber. The first chamber includes a first fluid outlet and the second chamber includes a second fluid outlet. A control device is affixed to the second fluid outlet configured to control the release of fluid from the second chamber through the second fluid outlet. The system further comprises a second apparatus containing a fluid having a fluid level and connected to the fluid inlet of the first apparatus such that the fluid level in the second apparatus corresponds to a fluid level in the first chamber of the first apparatus. The system further comprises a third apparatus affixed to the first fluid outlet.

In an embodiment of the first apparatus according to the second aspect of the invention, the control device comprises a valve configured to be opened and closed to control the release of fluid through the second fluid outlet. The valve can be controlled by a lever affixed to a housing for the control device. The control device in an embodiment of the invention can be a standard shut-off valve.

In a further embodiment of the system according to the second aspect of the invention, the inner wall of the first apparatus is configured to have a height such that fluid in the first chamber will overflow into the second chamber when the level of the fluid in the first chamber rises above the height of the inner wall. The valve of the control device is configured to be opened to permit the release of fluid from the second chamber until the fluid level in the second apparatus is such that the fluid level in the first chamber is at or below the height of the inner wall.

According to a further embodiment of the system according to the second aspect of the invention, a fluid level adjustment unit is provided and configured to be placed on the inner wall within the first apparatus. The fluid level adjustment unit is positioned on the inner wall so that a top surface of the fluid level adjustment unit defines a height wherein fluid in the first chamber will overflow into the second chamber when the level of the fluid in the first chamber rises above the top surface of the fluid level adjustment unit at said height. The valve of the control device is configured to be opened to permit the release of fluid from the second chamber until the fluid level in the second apparatus is such that the fluid level in the first chamber is at or below the height of the top surface of the fluid level adjustment unit.

In an embodiment of the system according to the second aspect of the invention, the second apparatus is a swimming pool, the first apparatus is a pool skimming unit configured to skim water and debris from the top surface of the pool, and further comprises a basket or mesh strainer positioned above the first fluid outlet and configured to adjust the fluid level in the swimming pool to a level related to the height of the inner wall, and the third apparatus is a filtration system

DETAILED DESCRIPTION OF THE DRAWINGS

Figure 2A:
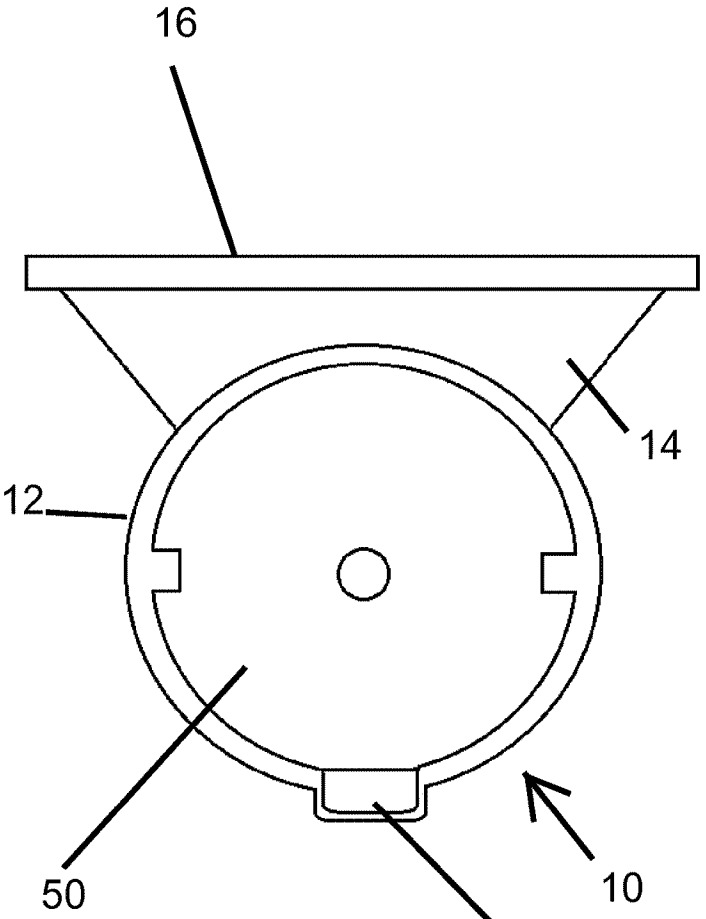
FIG. 2A is a top view of the containment unit according to an embodiment of the invention.
Figure 1:
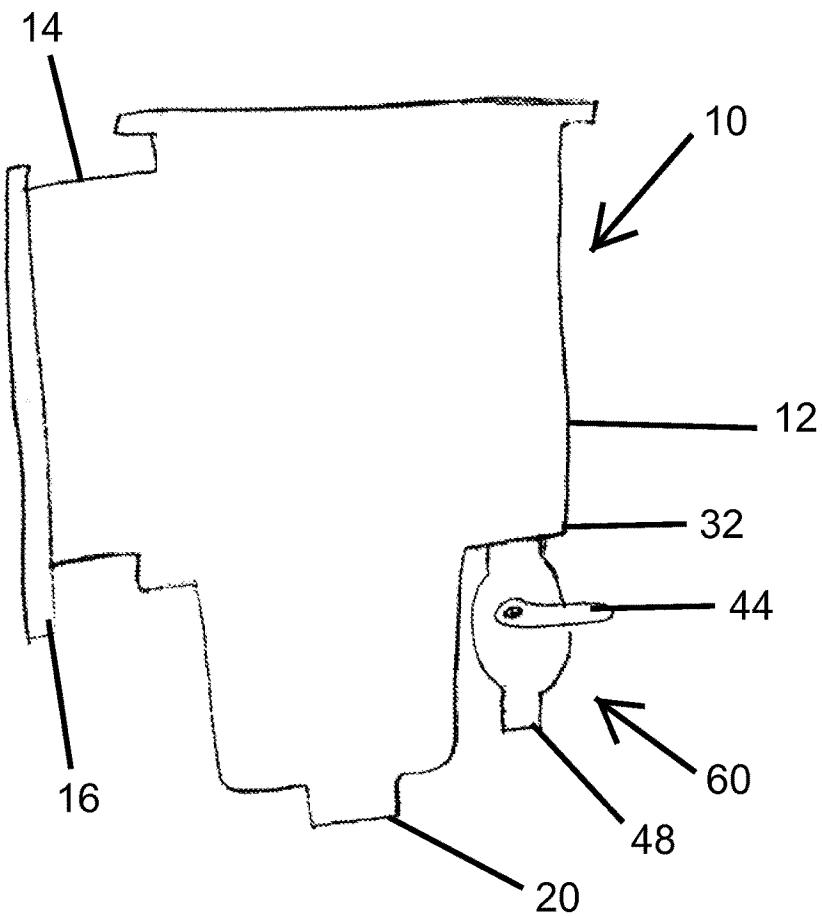
FIG. 1 is a perspective view of the containment unit according to an embodiment of the invention.
Figure 2B:
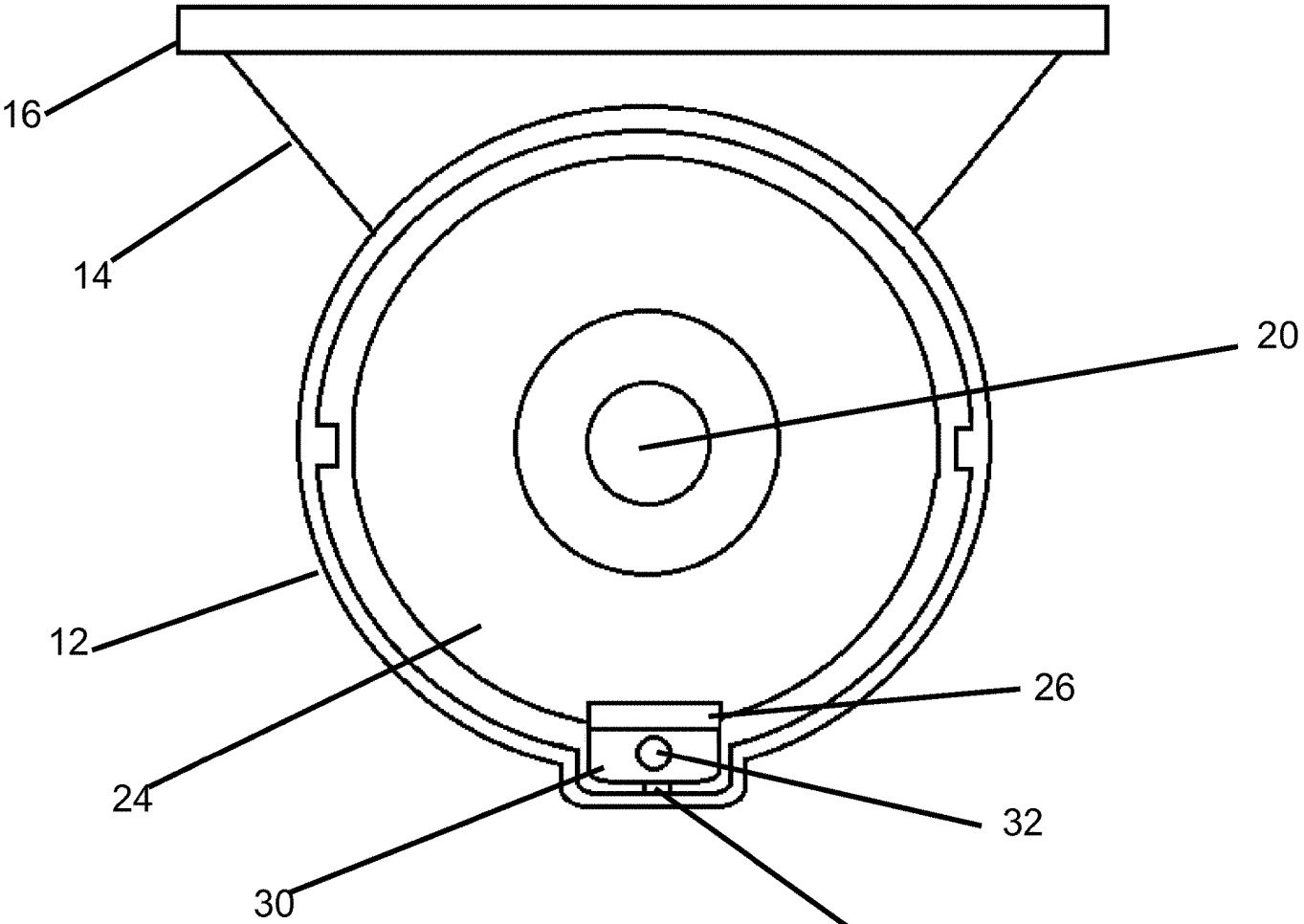
FIG. 2B is a top view of the containment unit with the covers removed, according to an embodiment of the invention.

The present invention will now be described in relation to FIGS. 1-6. As shown in FIG. 1, a containment unit 10 is provided for use in connection with a fluid source, which provides fluid into the containment unit 10. In a one embodiment, the containment unit 10 according to the present invention is used in connection with a swimming pool as a pool skimmer unit, and is integrated into the filtering system of the swimming pool. However, in addition to being configured to perform the functions of pool skimmer unit, the containment unit 10 according to the present invention is configured to control the water level in the swimming pool by comprising a fluid level control mechanism.

The containment unit 10 according to the present invention includes a housing 12, which defines the exterior shape and structure of the containment unit 10 and includes a plurality of openings for the inlet and outlet of fluids. In a preferred embodiment, the containment unit 10 and housing 12 are made from a durable, plastic material as would be known by those of skill in the art. However, the containment unit 10 according to the invention is not limited to being manufactured from this material, but can be made from any suitable material known in the art.

The containment unit 10 includes a fluid inlet 14, which receives and intakes fluid from a fluid source. A fluid inlet connector 16 connects the containment unit 10 to the fluid source, by fasteners such as screws or bolts, or other suitable means, such that an outlet from the fluid source is aligned with the fluid inlet 14. In a preferred embodiment, the fluid source is a swimming pool, or a hot tub, and the fluid inlet 14 takes in water from the swimming pool into the containment unit 10. In such an embodiment, the fluid inlet 14 and fluid inlet connector 16 can be configured similarly to the corresponding parts on a standard pool skimming unit known in the art. The fluid inlet connector 16 and fluid inlet 14 can also be manufactured in different sizes or shapes for use with differently shaped or sized connectors on swimming pools or other fluid sources, including being substantially square, rectangular, circular or ovular in shape. The containment unit 10 according to the present invention is not limited to use in connection with a swimming pool, but can be used in connection with other fluid-containing structures or bodies where the fluid level is to be regulated.

The containment unit 10 further includes a fluid outlet 20. The fluid outlet 20 is preferably arranged in the base of the containment unit 10, so that gravity aids in the drainage of fluid through the fluid outlet 20. The fluid outlet 20 may include a threaded section 22, for securing the fluid outlet 20 to a hose, pipe, or other connector, which includes a corresponding threaded section. In the embodiments shown in the Figures, the threaded section 22 is oriented on an inner surface of the fluid outlet 20 to create a female connection port; however, in other embodiments the threaded section 22 may be oriented on the outer surface of the fluid outlet 20 to create a male connection port. Where the containment unit 10 is a swimming pool skimming unit, the fluid outlet 20 can be connected to a pool filtering system. The containment unit 10 in this embodiment skims the water from the top surface of the swimming pool, along with any debris, such as leaves or insects, which enter the containment unit 10 through the fluid inlet 14. A mesh strainer or basket (not shown) is positioned above the fluid outlet 20, which allows the water to pass through to the fluid outlet 20, which leads to the filtering system, while preventing any large debris from passing through to the filtering system. The mesh strainer or basket can be removed from the containment unit 10 and emptied.

The fluid outlet 20 is positioned within an inner chamber 24 of the containment unit 10. As shown in the Figures, an inner wall 26 is provided inside the containment unit 10, which separates the inner chamber 24 from a separate, overflow chamber 30. The inner wall 26 does not extend the full height of the containment unit 10, relative to the surrounding housing 12, such that if the fluid level in inner chamber 24 rises above the height of the inner wall 26, the fluid from the inner chamber 24 will spill over the inner wall 26 and into the overflow chamber 30.

The overflow chamber 30 comprises an overflow fluid outlet 32. The overflow fluid outlet 32 is preferably arranged in the base of the overflow chamber, so that gravity aids in the drainage of fluid through the overflow fluid outlet 32. The fluid outlet 32 may include a threaded section 34, for securing the overflow fluid outlet 32 to a correspondingly threaded section. In the embodiments shown in the Figures, the threaded section 34 is oriented on an inner surface of the overflow fluid outlet 32 to create a female connection port; however, in other embodiments the threaded section may be oriented on the outer surface of the overflow fluid outlet 32 to create a male connection port.

In an embodiment of the containment unit 10 of the invention, a control valve 40 is provided that mates with and is connected to the overflow fluid outlet 32. The control valve 40 can be a shut-off valve, as known to those having skill in the art. The control valve 40 includes a control valve housing 42, inside of which is contained a valve that is configured to be opened and closed by a rotatable lever 44 attached to the control valve housing 42. A control valve inlet 46 is provided, which is connected to the overflow fluid outlet 32, and a control valve outlet 48 is provided, which can be optionally be connected to a threaded member, such as a hose, pipe, or other connector. The control valve inlet 46 and outlet 48 may include threaded sections 46*a* and 48*a*, respectively, for connecting to other objects having corresponding threaded sections. As shown for example in FIG. 4, the control valve 40 is connected to the containment unit 10 by securing the threaded section 46*a* of the control valve inlet 46 to the threaded section 34 of the overflow fluid outlet 32.

Whether the control valve 40 is in the opened or closed position controls whether the overflow chamber 30 can be drained. When the control valve 40 is in an opened position, any fluid in the overflow chamber 30 will be drained through the overflow fluid outlet 32 and control valve 40, however when the control valve 40 is in a closed position, fluid will not drain from the overflow chamber 30.

The containment unit 10 is further provided with a large top cover 50 and a small top cover 52, which cover the containment unit 10 to prevent objects from falling into the containment unit 10. The large top cover 50 is substantially dimensioned to cover the inner chamber 24 of the containment unit 10 and the small top cover is substantially dimensioned to cover the overflow chamber 30 of the containment unit 10. Extending from and below the small top cover 52 are one or more tabs 54*a*, 54*b*. One of the tabs 54*a* is dimensioned to fit into a tab receiving section 56 in the housing 12 of the containment unit 10 and mate therewith. After securing the small top cover 52 in place, the large top cover 50 can be placed over the small top cover 52, and aligned and inserted into the containment unit 10 to cover the inner chamber 24 of the containment unit 10. In a preferred embodiment, horizontal rotation of the large top cover 50 will lock the large top cover 50 onto the containment unit 10, however, other means for securing the large top cover 50 to the containment unit 10 can be provided, such as threaded sections or tabs. The small top cover 52 will be fixed into position once the large top cover 50 has been secured to the containment unit 10, as the large top cover 50 is secured atop a tab 54*b* of the small top cover 52.

Figure 4:
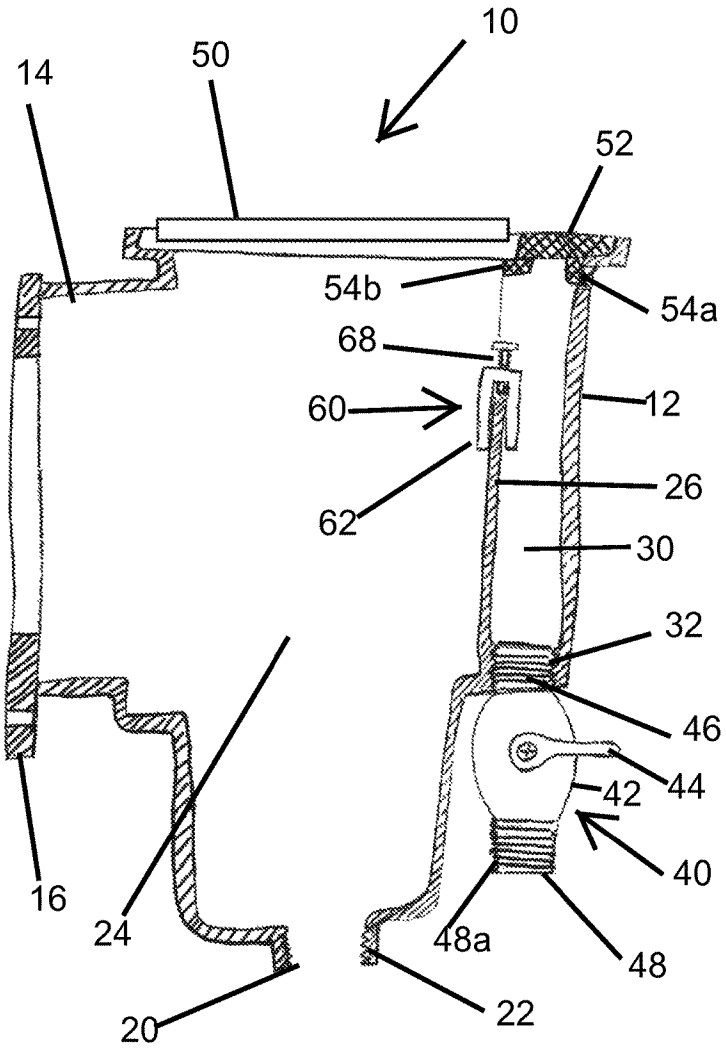
FIG. 4 is a cross-sectional view of the containment unit according to an embodiment of the invention.
Figure 3:
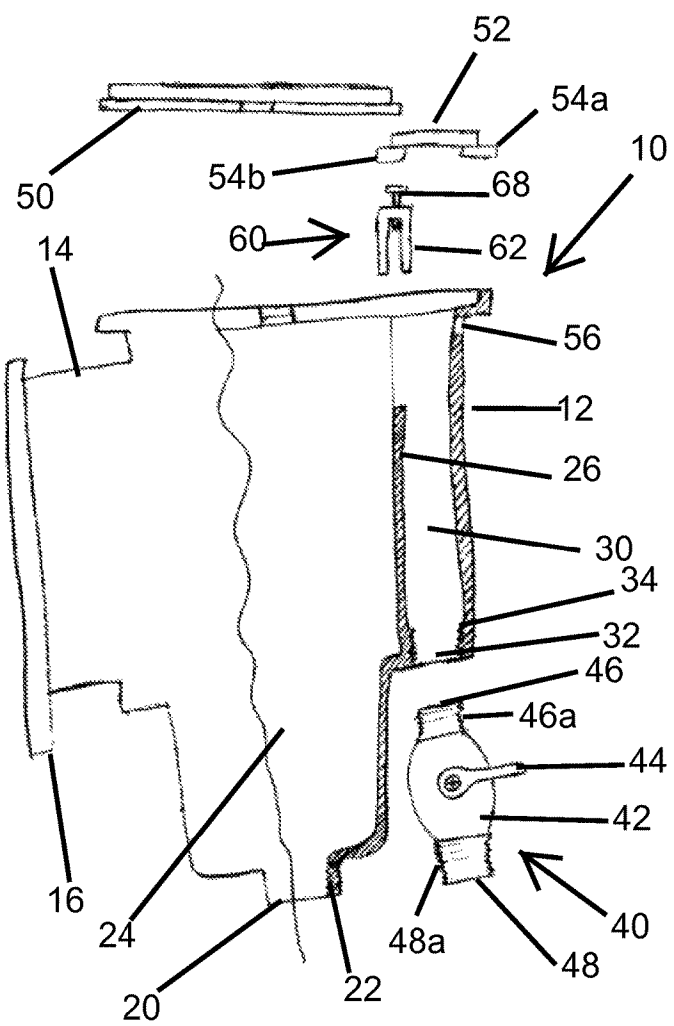
FIG. 3 is an exploded, partial cross-sectional view of the containment unit according to an embodiment of the invention.

According to an embodiment of the invention, a fluid level adjustment unit 60 can be provided to adjust the height of the inner wall 26, defining the maximum fluid level $L_{max}$ within the inner chamber 24 in the containment unit 10 before fluid will spill into the overflow chamber 30. The fluid level adjustment unit 60 is shown, for example, in FIG. 6. The fluid level adjustment unit 60 comprises a U-shaped member 62 that is placed over the inner wall 26 as shown in FIG. 4. In a preferred embodiment, the U-shaped member 62 is dimensioned as having the same length as the inner wall 26, in order to prevent fluid from seeping around the fluid level adjustment unit 60 in between the housing 12 and the edges of the U-shaped member 62. The U-shaped member 62 defines the top surface 64 of the fluid level adjustment unit 60, and includes a threaded bore hole 66 extending therethrough. The bore hole 66 is configured to receive a threaded member 68. When the threaded member 68 is inserted into the bore hole 66, the rotation of the threaded member 68 causes the U-shaped member 62 to elevate along the threaded member 68, once the threaded member 68 is in contact with the inner wall 26 of the containment unit 10, thereby raising the top surface 64 of the fluid level adjustment unit 60. The effective height of inner wall 26 can therefore be altered using the fluid level adjustment unit 60, adjusting the maximum fluid level ($L_{max}$) that can be reached in the containment unit 10 before fluid will spill into the overflow chamber 30.

Figure 5B:
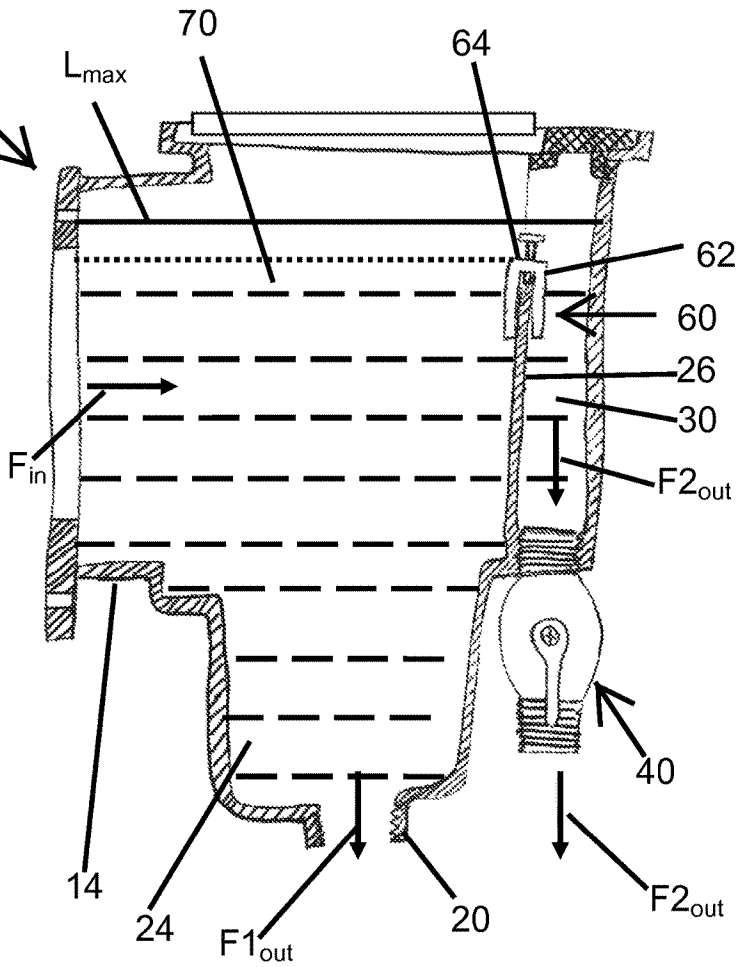
FIG. 5B is a cross-sectional view of the containment unit filled with a first level of fluid according to an embodiment of the invention.
Figure 5A:
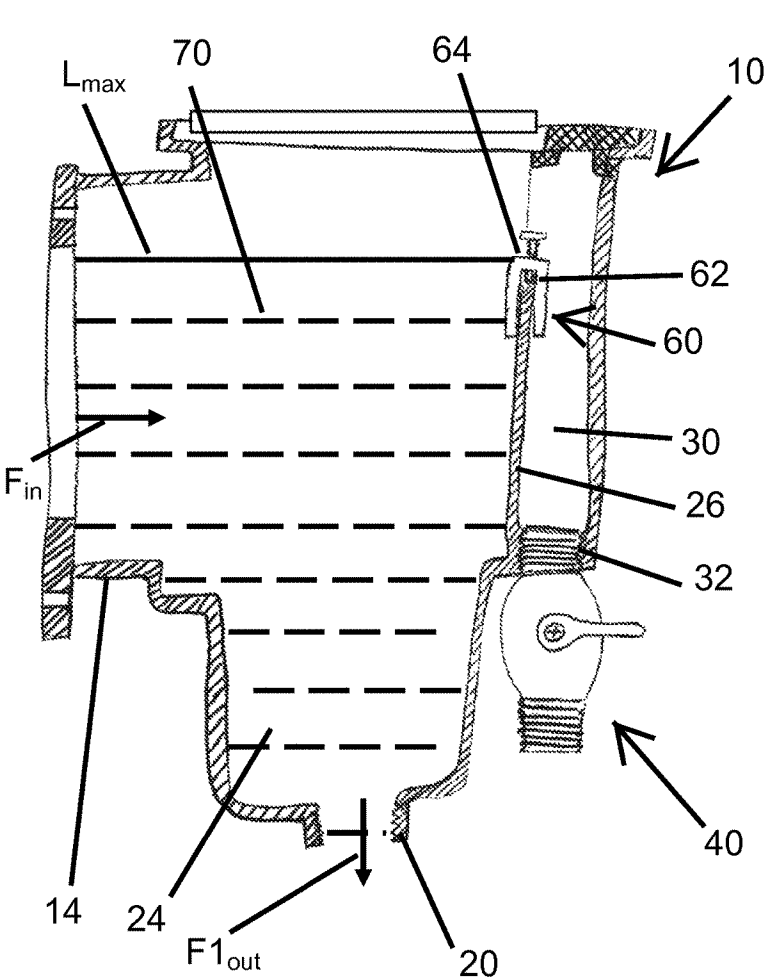
FIG. 5A is a cross-sectional view of the containment unit filled with a first level of fluid according to an embodiment of the invention.
Figure 6:
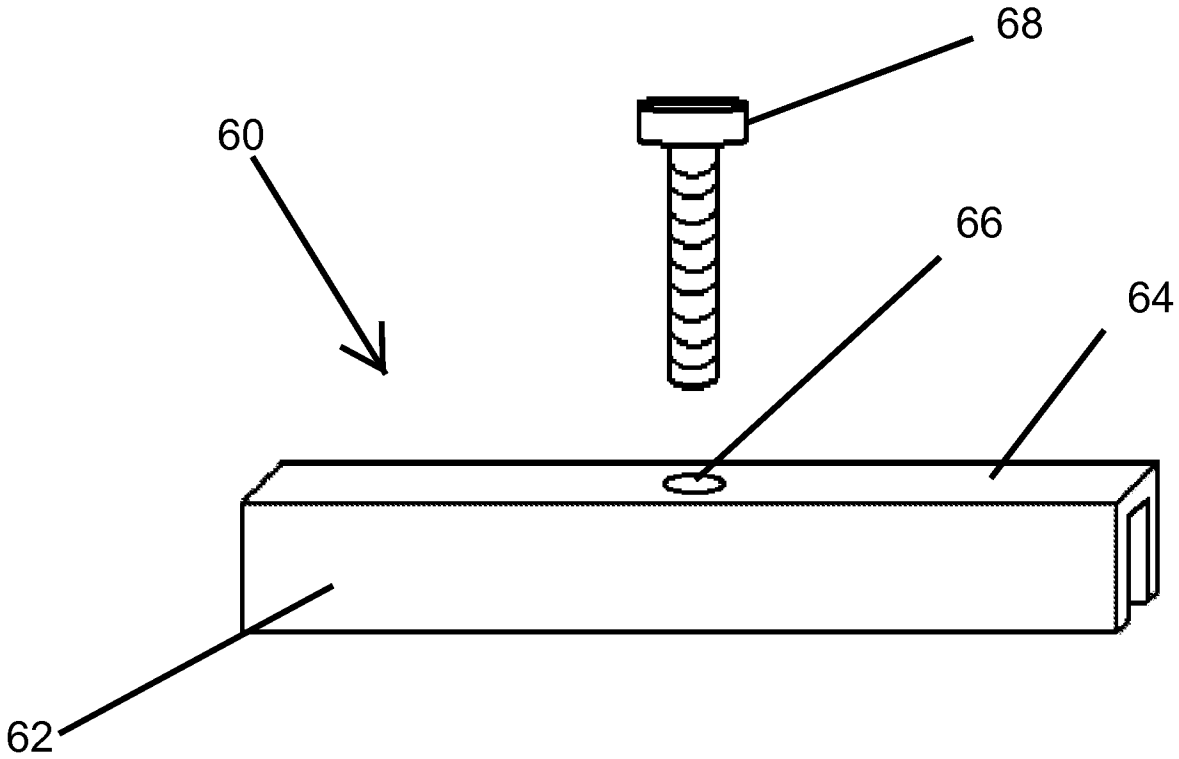
FIG. 6 is a perspective, exploded view of a fluid level adjustment unit according to an embodiment of the invention.

The operation of the present invention will now be described with reference made to FIGS. 5A and 5B. In the embodiment discussed herein, the containment unit 10 is used in connection with an above-ground or a below-ground swimming pool and serves as a pool skimming unit as described above, however the present invention is not limited to this embodiment.

The containment unit 10 can be connected to an opening near the top surface of the swimming pool (not shown), by way of fluid inlet connector 16, which is securely fastened to the opening in the swimming pool. The containment unit 10 is configured to skim the water 70, and any debris, from the top surface of the swimming pool, through the fluid inlet 14 into the containment unit 10. In an embodiment of the invention, the containment unit 10 is connected to the swimming pool at a level were the height of the inner wall 26 is in alignment with the desired maximum water level $L_{max}$ in the swimming pool. In other embodiments as shown in FIGS. 5A and 5B, if the inner wall 26 is short of the desired maximum fluid level $L_{max}$, the fluid level adjustment unit 60 can be placed onto the inner wall 26 and adjusted to the appropriate height, so that the top surface 62 of the fluid level adjustment unit 60 is in line with the maximum fluid level $L_{max}$. Alternatively, if the containment unit 10 is positioned relative to the swimming pool such that the inner wall 26 rises above the maximum water level $L_{max}$, the height of the inner wall 26 can be reduced by cutting off a section of the inner wall 26 or by providing in the containment unit 10 an inner wall 26 that is adjustable, for example, by being formed from a pliable material that can be folded along one or more creases or hinges formed in the inner wall 26. The amount of water 70 that is in the containment unit 10 is reflective of the amount of water 70 in the swimming pool, such that the water level is even across the containment unit 10 and swimming pool, unless the containment unit 10 is full.

If the water level in the swimming pool, and thus the inner chamber 30, is at or below the maximum water level $L_{max}$, the water 70 flows through the containment unit 10 only in a single flow path designed for recirculation of water through the filtering system. Water 70 flows into ($F_{in}$) the inner chamber 30 of the containment unit 10 through the fluid inlet 14, and flows out ($F1_{out}$) of the inner chamber 30 of the containment unit 10 through the fluid outlet 20, to the swimming pool filtering system (not shown).

If the water level in the swimming pool and the inner chamber 30 rises above the maximum water level $L_{max}$, as defined by the height of the inner wall 26 or the fluid level adjustment unit 60, the water 70 can flow through the containment unit 10 along two, separate flow paths. First, as previously described, to filter and recirculate the pool water, water 70 flows into ($F_{in}$) the inner chamber 30 of the containment unit 10 through the fluid inlet 14, and flows out ($F1_{out}$) of the inner chamber 30 of the containment unit 10 through the fluid outlet 20, to the filtering system. In addition, as the water 70 rises above the maximum water level $L_{max}$, the water 70 flows over the inner wall 26 and into the overflow chamber 30. If the control valve 40 is in the open position, as shown in FIG. 5B, then any water 70 in the overflow chamber 30 will follow a second flow path ($F2_{out}$) for controlling the water level, flowing out the overflow fluid outlet 32 through the control valve 40. As long as the control valve 40 is opened, the flow of the water 70 out through overflow fluid inlet 32 will continue until the overflow chamber 30 is empty, and the water level in the containment unit 10 lowers to the maximum water level $L_{max}$. As an example, if the water level in the swimming pool rises above the desired maximum water level $L_{max}$ as a result of rain, the opening of the control valve 40 will cause the water 70 to exit the containment unit 10. If the containment unit 10 is full, as water 70 exits through the overflow fluid outlet 32, additional water 70 will enter the containment unit 10 from the swimming pool through fluid inlet 14. This continues until the water level to drop to the desired maximum water level $L_{max}$, or the control valve 40 is closed. Once the water level in the swimming pool has reached the maximum water level $L_{max}$, the water level in the inner chamber 30 of containment unit 10 will be aligned with the inner wall 26 or the top surface 62 of the fluid level control unit, if placed on the inner wall 26.

When the control valve 40 is closed, even if the water level in the swimming pool and in the containment unit 10 rises above the maximum water level $L_{max}$, the overflow chamber 30 will not drain through overflow fluid outlet 32. For example, if one or more people are in the swimming pool, the displacement of water caused by the swimmers will raise the water level in the swimming pool and thus the containment unit 10. In such an instance, closing the control valve 40 will prevent the drainage of water rising above the maximum water level $L_{max}$, as a result of temporary water displacement, which will thus prevent the water level in the swimming pool from falling below the desired water level once the swimmers have left the swimming pool and there is no effective water displacement.

The containment unit 10 according to the invention therefore allows for the regulation and control of the water level in the swimming pool while separately functioning as the pool skimming unit forming part of the filtering system of the swimming pool.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. Furthermore, in the claims means-plus-function clauses are intended to cover the structures described herein as performing the recited function and not only structural equivalents, but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. An apparatus comprising:

a housing surrounding a first chamber and a second chamber, the first and second chambers partially separated by an inner wall;

a fluid inlet connected to the housing configured to receive fluid into the first chamber;

a first fluid outlet in the first chamber;

a second fluid outlet in the second chamber;

a control device affixed to the second fluid outlet configured to control the release of fluid from the second chamber through the second fluid outlet; and a fluid level adjustment unit configured to be placed on the inner wall within the apparatus comprising:

a U-shaped member configured to fit over the inner wall;

a threaded bore hole extending through the U-shaped member; and a threaded member configured to be inserted into the threaded bore hole;

wherein the threaded member is configured to elevate the U-shaped member away from the inner wall as the threaded member is threaded into the threaded bore hole.

2. The apparatus according to claim 1, wherein the control device comprises a valve configured to be opened and closed to control the release of fluid through the second fluid outlet.

3. The apparatus according to claim 2, wherein the valve is controlled by a lever affixed to a control device housing.

4. The apparatus according to claim 1, wherein the fluid inlet comprises a fluid inlet connector configured to connect the apparatus to a second apparatus comprising a fluid so that the fluid enters the apparatus through the fluid inlet.

5. The apparatus according to claim 4, wherein the fluid inlet connector is configured to connect the apparatus to an opening in a swimming pool.

6. The apparatus according to claim 5, wherein the apparatus is a pool skimming unit configured to skim water and debris from the top surface of the swimming pool, and further comprises a basket or mesh strainer positioned above the first fluid outlet, and the first fluid outlet is connected to a filtration system.

7. The apparatus of claim 1, further comprising a first cover dimensioned to cover a top surface of the second chamber, and comprising at least a first tab configured to be inserted into a tab receiving section in the housing.

8. The apparatus of claim 7, further comprising a second cover dimensioned to cover a top surface of the first chamber, wherein the second cover is configured to overlay at least a second tab of the first cover.

9. The apparatus of claim 1, wherein the fluid level adjustment unit is positioned on the inner wall so that a top surface of the U-shaped member defines a height wherein fluid in the first chamber will overflow into the second chamber when the level of the fluid in the first chamber rises above the top surface of the U-shaped member at said height.

10. The apparatus according to claim 1, wherein the fluid inlet comprises a fluid inlet connector configured to connect the apparatus to a second apparatus comprising a fluid so that the fluid enters the apparatus through the fluid inlet, and wherein the fluid level adjustment unit is positioned on the inner wall so that a top surface of the U-shaped member defines a height wherein fluid in the first chamber will overflow into the second chamber when the level of the fluid in the first chamber rises above the top surface of the U-shaped member at said height.

11. The apparatus according to claim 10, wherein the second apparatus has an adjustable fluid level and the fluid level in the first chamber corresponds to the fluid level in the second apparatus, and wherein the control device is configured to permit the release of fluid from the second chamber until the fluid level in the second apparatus is such that the fluid level in the first chamber is at or below the height of the top surface of the U-shaped member of the fluid level adjustment unit.

* * * * *